US006325133B1

(12) United States Patent
Lin

(10) Patent No.: US 6,325,133 B1
(45) Date of Patent: Dec. 4, 2001

(54) MODULATING MECHANISM OF VENETIAN BLIND

(75) Inventor: Jung-Kuei Lin, Hsinchu (TW)

(73) Assignees: Industrial Technology Research Institute, Hsinchu Hsien; Nien Made Enterprise Co., Ltd., Changhua Hsien, both of (TW)

( * ) Notice: Subject to any disclaimer, the term of this patent is extended or adjusted under 35 U.S.C. 154(b) by 0 days.

(21) Appl. No.: 09/705,736

(22) Filed: Nov. 6, 2000

(51) Int. Cl.[7] ..... E06B 9/26
(52) U.S. Cl. ..... 160/177 R
(58) Field of Search ..... 160/177 R, 177 V, 160/176.1 R, 176.1 V, 168.1 R, 173 R, 172 R, 178.1 R

(56) References Cited

U.S. PATENT DOCUMENTS 3,921,695 * 11/1975 Debs ..... 160/177 R X
4,507,831 * 4/1985 McClure ..... 160/177 R X
4,875,516 * 10/1989 Marocco ..... 160/177 R X
4,955,248 * 9/1990 Lindstrom ..... 160/177 R X
5,002,113 * 3/1991 Georgopoulos ..... 160/176.1 R
5,092,387 * 3/1992 King et al. ..... 160/176.1 R
5,186,229 * 2/1993 Hsu ..... 160/177 R
5,396,945 * 3/1995 Meyer ..... 160/177 R

* cited by examiner

*Primary Examiner*—David M. Purol
(74) *Attorney, Agent, or Firm*—Browdy and Neimark

(57) ABSTRACT

A slat-modulating mechanism of the Venetian blind comprises a housing in which a worm gear is pivoted such that the worm gear is meshed with a worm shaft. The worm shaft is formed of a link member and an extension member which is fastened end to end with the link member such that the extension member projects out of the housing to be connected with an adjustment rod of the Venetian blind.

2 Claims, 3 Drawing Sheets

MODULATING MECHANISM OF VENETIAN BLIND

FIELD OF THE INVENTION

The present invention relates generally to a Venetian blind, and more particularly to a modulating mechanism of the Venetian blind.

BACKGROUND OF THE INVENTION

The Venetian blind is made of a number of slats that can be set together at any angle to regulate the light and the air to pass through, or be drawn up together to the top of the window by means of cords. The angle of the slats is adjusted by a modulating mechanism in conjunction with an adjustment rod.

As shown in FIG. 1, the conventional modulating mechanism is mounted in the upper rail of the Venetian blind such that the worm rod 2 is slantingly engaged with the gear 3, so as to prevent the adjustment rod 1 from interfering the slats. The worm rod 2 is thus jutted out of the upper rail such that one end of the worm rod 2 is kept a distance away from the slats, thereby enabling the adjustment rod 1 and the slats to separate from one another. However, the portion of the worm rod 2 that is jutted out of the upper rail is apt to interfere with the slats located in proximity of the upper rail at the time when the slats are drawn up together to the top of the window. In addition, the worm rod 2 is vulnerable to breakage in the course of transportation of the Venetian blind. Moreover, the conventional modulating mechanism described above is apt to complicate the packaging of the Venetian blind.

SUMMARY OF THE INVENTION

The primary objective of the present invention is to provide the Venetian blind with a slat-modulating mechanism which is free of the deficiencies of the conventional mechanism described above.

The mechanism of the present invention comprises a housing in which a gear is mounted pivotally such that the gear is meshed with one end of a worm shaft. The worm shaft is formed of a link member and an extension member which is connected end to end with the link member and projects out of the housing. The connecting of the extension member with the link member is attained by a connection set.

DETAILED DESCRIPTION OF THE INVENTION

Figure 1:
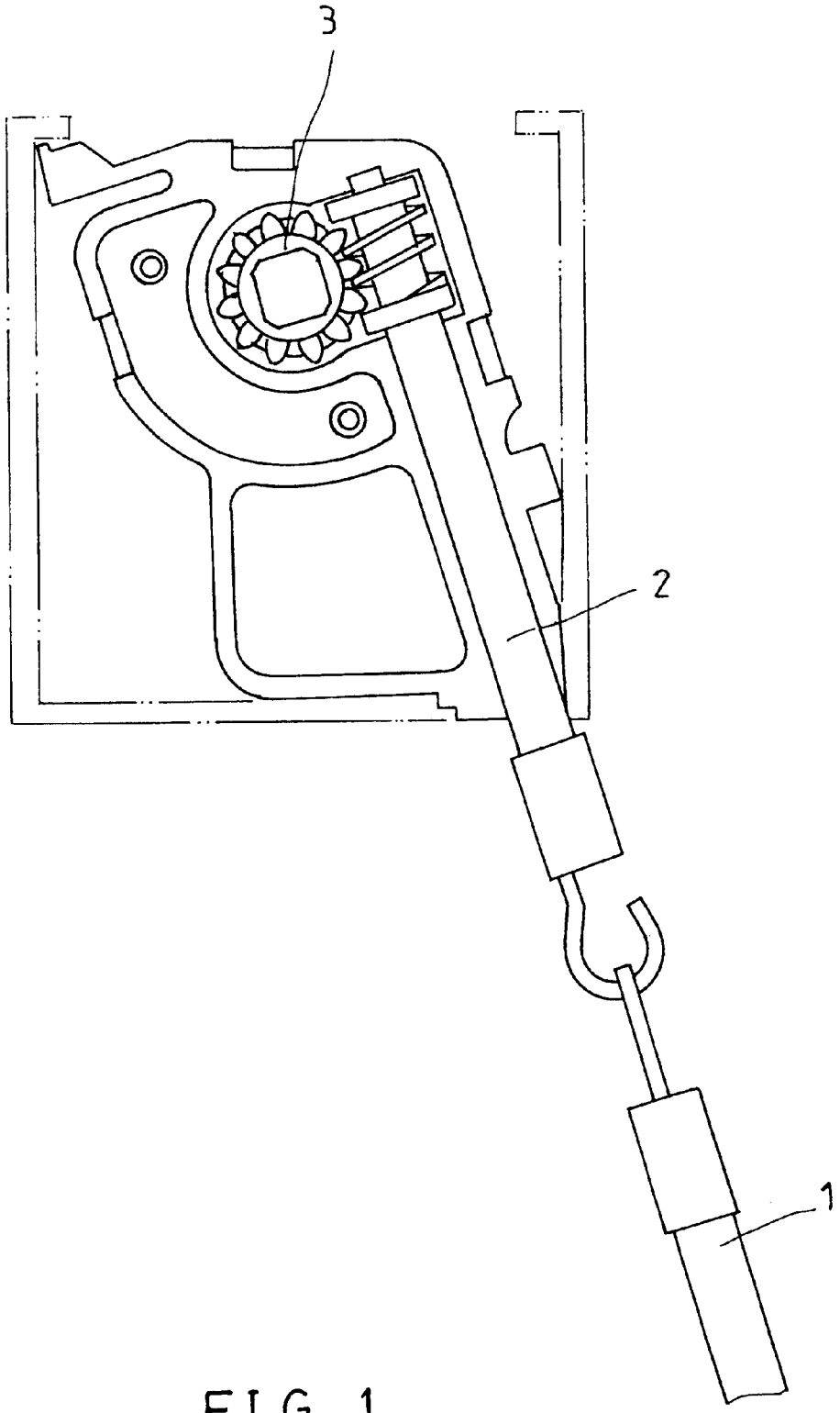
FIG. 1 PRIOR ART
FIG. 1 shows a schematic view of the conventional slat-modulating mechanism of the Venetian blind.
Figure 2:
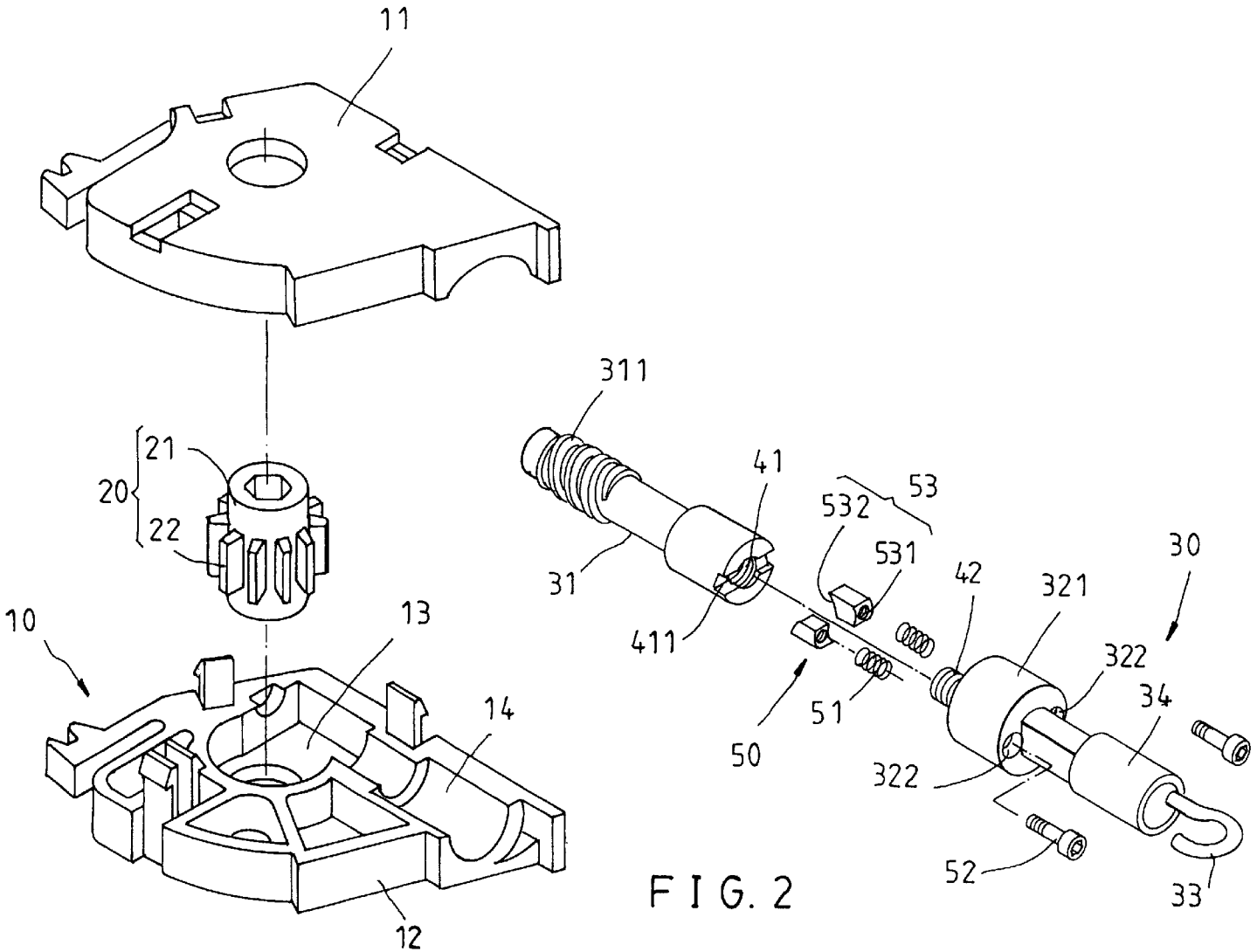
FIG. 2 shows an exploded view of a preferred embodiment of the present invention.
Figure 3:
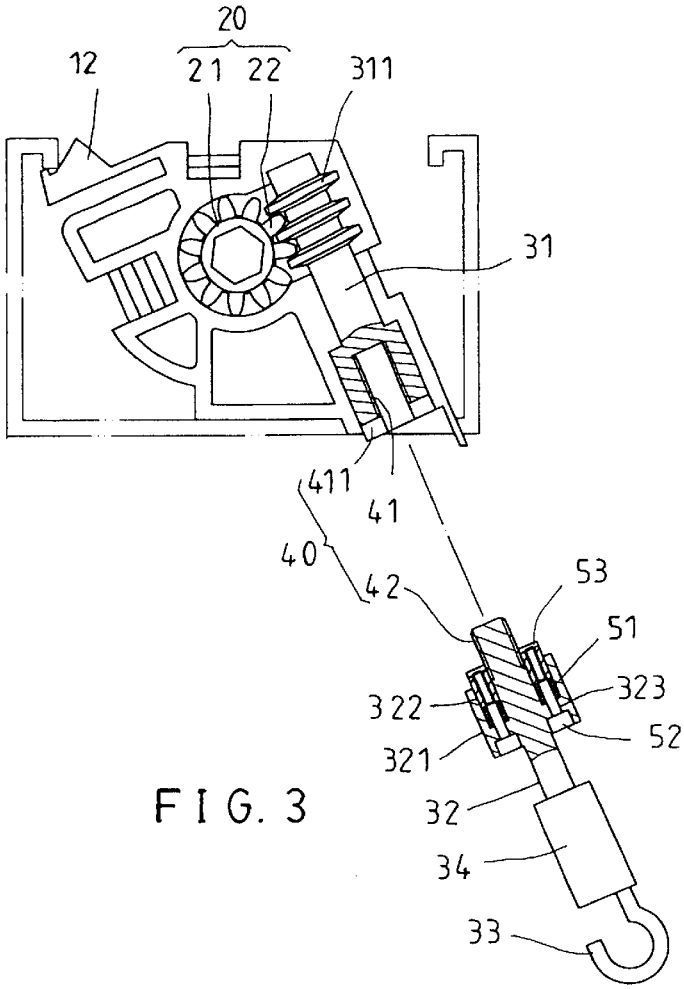
FIG. 3 shows a schematic plan view of the preferred embodiment of the present invention before the assembly of the worm shaft.
Figure 4:
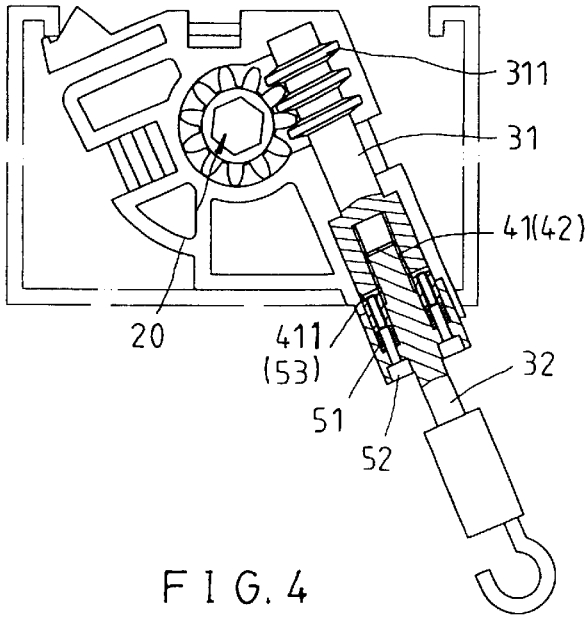
FIG. 4 shows a schematic plan view of the preferred embodiment of the present invention after the assembly of the worm shaft.

As shown in FIGS. 2 and 3, a slat-modulating mechanism embodied in the present invention comprises a housing 10, a gear 20, a worm shaft 30, a connection set 40, and two urging units 50.

The housing 10 is formed of an upper housing 11, a lower housing 12, a receiving space 13, and a shaft hole 14.

The gear 20 is pivotally mounted in the receiving space 13 of the housing 10 by means of a spindle 21. The spindle 21 is provided in the midsegment with a spiral portion 22.

The worm shaft 30 is formed of a link member 31 and an extension member 32 connected end to the link member 31. The link member 31 is received in the shaft hole 14 of the housing 10 such that the link member 31 is located in the housing 10. The link member 31 is provided at one end with a worm gear 311, which is meshed with the spiral portion 22 of the spindle 21 of the gear 20. The extension member 32 is provided at the front end with a columnar portion 321 which is provided with two through holes 322, with each having a shoulder 323. The rear end of the extension member 32 projects out of the housing 10 and is provided with a hook 33 and a movable sleeve 34. The hook 33 is used to retain an adjustment rod (not shown in the drawings) of the Venetian blind.

The connection set 40 comprises a threaded hole 41 which is located in the other end of the link member 31, and a threaded portion 42 which is located at the front end of the extension member 32. The threaded hole 41 of the link member 31 is provided in the outer edge with two section slots 411. The link member 31 is connected with the extension member 32 such that the threaded portion 42 is engaged with the threaded hole 41, and that the threaded portion 42 is contiguous to the columnar portion 321.

The stop units 50 are disposed on the extension member 32 and are formed of a spring 51, a threaded rod 52, and a retaining block 53. The spring 51 is received in the through hole 322 such that one end of the spring 51 urges the shoulder 323. The threaded rod 52 is fitted into the spring 51. The retaining block 53 has a threaded hole 531 and an inclined plane 532. The threaded rod 52 is engaged with the threaded hole 531. The link member 31 and the extension member 32 are fastened end to end such that the retaining blocks 53 are retained in the section slots 411, and that the inclined planes 532 of the retaining blocks 53 come in contact with the outer edges of the threaded hole 41. In light of the spring force of the spring 51, the retaining blocks 53 are retained in the section slots 411 at the time when the threaded portion 42 of the extension member 32 is threaded into a predetermined depth of the threaded hole 41 of the link member 31.

The Venetian blind can be packaged in such a way that the extension member 32 is packaged separately so as to avert the damage of the worm shaft 30 in the course of transportation of the Venetian blind.

The construction of the worm shaft 30 of the present invention is reinforced by the connection set 40 and the stop units 50 such that when the worm shaft 30 is actuated by the adjustment rod threaded portion 42 is not detached from threaded hole 41. The adjustment rod is retained by the hook 33 of the worm shaft 30 such that the adjustment rod is kept a distance away from the slats.

What is claimed is:

1. A slot-modulating mechanism for a Venetian blind, said mechanism comprising:

a housing;

a gear rotatably engaged in said housing;

a worm shaft formed by a link member and an extension member connected end to end by a threaded portion on the extension member threadedly engaged in a threaded hole in the link member;

said link member having a worm gear engaged in said housing to the gear;

said extension member extending out of said housing for connection to an adjustment rod for the Venetian blind; and stop means located between said link member and said extension member for precluding unthreading of the threaded portion from the threaded hole when the adjustment rod is actuated to adjust the Venetian blind.

2. The slat-modulating mechanism as defined in claim 1, wherein said threaded hole of said link member is provided in an outer edge with at least one section slot; wherein said extension member is provided with at least one through hole; wherein said stop means is formed of a spring, a threaded rod, and a retaining block, with said spring being disposed in said through hole of said extension member, with said threaded rod being fitted into said spring, and with said retaining block being retained in said section slot.

* * * * *